US006573655B1

(12) United States Patent
Ikedo et al.

(10) Patent No.: US 6,573,655 B1
(45) Date of Patent: Jun. 3, 2003

(54) GAS DISCHARGE TUBE

(75) Inventors: Tomoyuki Ikedo, Hamamatsu (JP); Kouzou Adachi, Hamamatsu (JP); Yoshinobu Ito, Hamamatsu (JP); Ryotaro Matui, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 370 days.

(21) Appl. No.: 09/602,475

(22) Filed: Jun. 23, 2000

Related U.S. Application Data

(63) Continuation-in-part of application No. PCT/JP98/05823, filed on Dec. 22, 1998.

(30) Foreign Application Priority Data

Dec. 24, 1997 (JP) ..... 9-355352
Sep. 7, 1998 (JP) ..... 10-252589

(51) Int. Cl.[7] ..... H01J 17/18
(52) U.S. Cl. ..... 313/623
(58) Field of Search ..... 313/623, 634, 313/631, 632, 568, 572, 573

(56) References Cited

U.S. PATENT DOCUMENTS

| | | | | |
|---|---|---|---|---|
| 2,309,967 A | | 2/1943 | Litton | |
| 2,916,646 A | | 12/1959 | Rohrer | |
| 4,020,379 A | | 4/1977 | Manning | 313/220 |
| 5,216,319 A | * | 6/1993 | Van Heeswijk | 313/318.01 |
| 5,250,872 A | * | 10/1993 | Wakimizu et al. | 313/25 |
| 6,121,621 A | * | 9/2000 | Warashina et al. | 250/372 |
| 6,339,280 B1 | * | 1/2002 | Miyamoto et al. | 313/113 |

FOREIGN PATENT DOCUMENTS

| | | |
|---|---|---|
| DE | 676 727 | 6/1939 |
| DE | 722 421 | 7/1942 |
| JP | 7-326324 | 12/1995 |
| JP | 8-77965 | 3/1996 |
| JP | 8-77969 | 3/1996 |
| JP | 8-77979 | 3/1996 |
| JP | 8-222185 | 8/1996 |
| JP | 8-222186 | 8/1996 |
| JP | 8-236081 | 9/1996 |
| JP | 10-302729 | 11/1998 |
| JP | 10-302730 | 11/1998 |
| JP | 10-302731 | 11/1998 |

* cited by examiner

*Primary Examiner*—Nimeshkumar D. Patel
*Assistant Examiner*—Holly Harper
(74) *Attorney, Agent, or Firm*—Morgan, Lewis & Bockius LLP

(57) ABSTRACT

In the gas discharge tube of the present invention, for elongating the life of the discharge tube itself while lowering the assembling temperature, a side tube itself is formed from glass, and a metal is employed in a joint between a stem and the side tube. Namely, a metal-made first peripheral portion provided in the stem and a metal-made second peripheral portion provided in the side tube are utilized in the joint. As a result, the discharge tube itself can be made smaller.

4 Claims, 4 Drawing Sheets

GAS DISCHARGE TUBE

RELATED APPLICATIONS

This is a Continuation-In-Part application of International patent application Ser. No. PCT/JP98/05823 filed on Dec. 22, 1998, now pending.

BACKGROUND OF THE INVENTION

1. Field of the Invention

The present invention relates to a gas discharge tube; and, in particular, to a gas discharge tube for use as a light source for a spectroscope, chromatography, or the like.

2. Background Art

As techniques in such a field, those disclosed in Japanese Patent Application Laid-Open Nos. HEI 7-326324 and HEI 8-222185 have conventionally been known. In the gas discharge tubes described in these publications, a sealed envelope is constituted by a side tube made of glass and a stem made of glass. Respective stem pins securing anode and cathode sections are plugged in the stem. This sealed envelope is filled with about several Torr of deuterium gas, for example. Such a gas discharge tube is known as a deuterium lamp and is utilized as a stable UV light source.

SUMMARY OF THE INVENTION

Since the conventional gas discharge tubes are configured as mentioned above, however, there have been problems as follows.

Namely, since the above-mentioned sealed envelope is made of glass as a whole from the viewpoint of freedom in processing, the temperature at the junction between the side tube made of glass and the stem made of glass exceeds 1000° C. when they are thermally fused to each other. For protecting the anode and cathode sections against this high temperature, it is necessary to employ a floating structure in which the anode and cathode sections are separated from the junction, whereby the sealed envelope increases its dimensions, which inevitably enlarges the gas discharge tube itself.

In order to overcome the problems mentioned above, it is an object of the present invention to provide a gas discharge tube which can achieve smaller dimensions while using a side tube made of glass.

In the process of carrying out experiments for making the discharge tube smaller, the inventors have groped for a method which does not yield a high temperature when joining the side tube and the stem to each other. As a result, it has been found that the rising temperature can be prevented due to the heat conduction to the anode and cathode sections upon joining the sealed envelope if the junction between the side tube and the stem is made of a metal. Namely, it has been found that, in this configuration, heat rises only about several tens of degrees in the anode and cathode sections upon joining, so that there are no thermal damages to the anode and cathode sections even in a structure in which the side tube is made so small that the cathode and anode sections are disposed closer to the side tube.

The present invention is achieved according to this finding. In order to overcome the above-mentioned problems, the gas discharge tube of the present invention has a sealed envelope at least a part of which transmits light, the sealed envelope is filled with a gas and is provided with anode and cathode sections disposed therein, electric discharge is generated between the anode and cathode sections, so that the light-transmitting part of the sealed envelope emits predetermined light outside. The sealed envelope is comprised of a stem for setting the anode and cathode sections within the sealed envelope by way of respective stem pins independent from each other, a first peripheral portion made of a metal firmly attached to a peripheral part of the stem, a second peripheral portion made of a metal secured to the first peripheral portion by welding, and a side tube, made of glass, surrounding the anode and cathode sections and having one end sealed with the second peripheral portion.

In the present invention, for elongating the life of the discharge tube while lowering the assembling temperature of the discharge tube, the side tube itself is formed from glass, whereas a metal is employed in the junction between the stem and the side tube. Namely, the first peripheral portion made of a metal firmly attached to the peripheral part of the stem and the second peripheral portion made of a metal sealing the side tube are utilized for joining. As a consequence, the thermal damage can be avoided even when the anode and cathode sections and the junction are positioned close to each other. Hence, the discharge tube itself can be made smaller.

Preferably, the first peripheral portion has a flange portion. In this case, a simple operation of mounting a peripheral part of the side tube onto the flange makes it easier to join the metal part of the stem and the metal part of the side tube to each other. Further, this flange portion can be utilized as a reference position with respect to the light-emitting part of the discharge tube.

Preferably, the second peripheral portion has also flange portion being secured with respective flange portion of the first peripheral portions by welding. Employing such a configuration facilitates the operation of welding metals to each other as the flanges of the stem and side tube are faced to each other, whereby the welding operation such as electric welding, laser welding, or the like can be made more reliable.

More preferably, each of these flange portions is provided with a positioning part. The position of the light-emitting part of the discharge tube can accurately be determined by use of this positioning part.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF DRAWINGS

FIG. 3 is a sectional view showing another embodiment of the gas discharge tube in accordance with the present invention, whereas

DETAILED DESCRIPTION OF PREFERRED EMBODIMENTS

Figure 1:
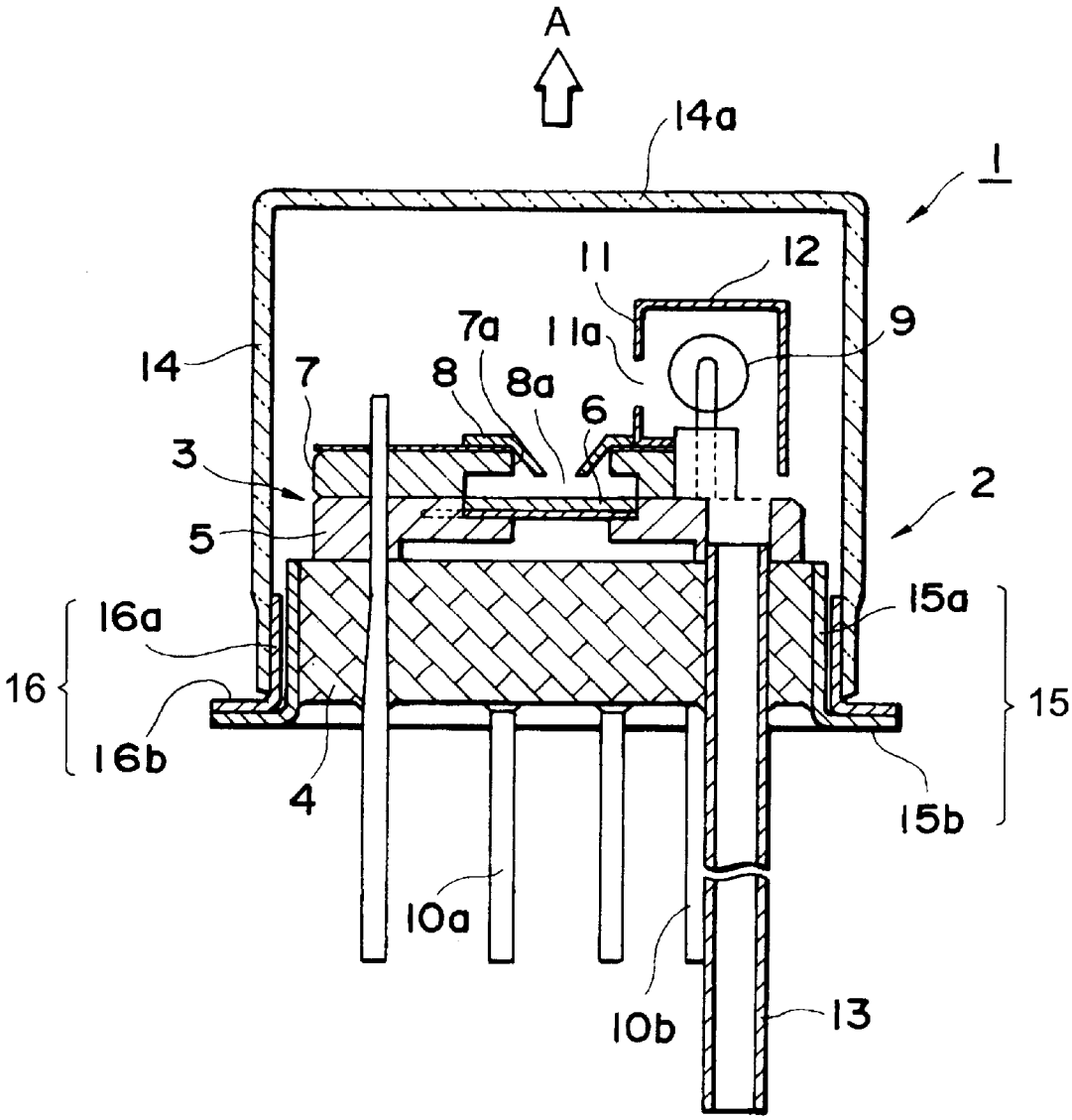
FIG. 1 is a sectional view showing an embodiment of the gas discharge tube in accordance with the present invention.

In the following, preferred embodiments of the gas discharge tube in accordance with the present invention will be explained in detail with reference to the accompanying drawings. To facilitate the comprehension of the explanation, the same reference numerals denote the same parts, where possible, throughout the drawings, and a repeated explanation will be omitted.

FIG. 1 is a sectional view showing a first embodiment of the gas discharge tube in accordance with the present invention. The gas discharge tube 1 shown in this drawing is a head-on type deuterium lamp and has a sealed envelope 2 filled with about several Torr of deuterium gas, whereas a light-emitting part assembly 3 is contained in the sealed envelope 2. The light-emitting part assembly 3 has an anode support plate 5 which is made of ceramics and disposed on a stem 4. An anode plate 6 is disposed on the anode support plate 5, so as to be spaced from the stem 4. The anode plate 6 is welded and secured to the upper end of a stem pin 10*a* which is fixed so as to penetrate through the stem 4. A spacer 7 made of ceramics is disposed on the anode support plate 5, a focusing electrode plate 8 is disposed on the spacer 7, and a focusing opening 8*a* formed in the focusing electrode plate 8 is disposed so as to face into an opening 7*a* of the spacer 7, whereby the anode plate 6 and the focusing electrode plate 8 are opposed each other.

Beside the focusing opening 8*a*, a cathode section 9 is disposed on the upper side from the spacer 7. The cathode section 9 is welded and secured to the upper end of a stem pin 10*b* fixed so as to penetrate through the stem 4, and generates thermions upon electric discharge. Between the cathode section 9 and the focusing opening 8*a*, a discharge rectifying plate 11 is disposed at a position deviated from an optical path (formed in the direction directly upward from the focusing opening 8*a*). The discharge rectifying plate 11 is provided with an electron releasing window 11*a* formed as a rectangular opening for transmitting thermions therethrough. Also, the discharge rectifying plate 11 is welded and secured to the upper face of the focusing electrode plate 8, and is provided with a cover plate 12 having an L-shaped cross section so as to surround the upper side of the cathode section 9 and the rear side thereof opposite from the electron releasing window 11*a*. The cover plate 12 keeps the sputtering materials or evaporated materials released from the cathode section 9 from attaching to a light projection window 14*a*.

While thus configured light-emitting part assembly 3 is disposed within the sealed envelope 2, an exhaust pipe 13 is secured to the stem 4 since it is necessary for the sealed envelope 2 to be filled with several Torr of deuterium gas. Utilizing this exhaust pipe 13 at the time of manufacture, the sealed envelope 2 can be appropriately filled with a predetermined pressure of deuterium gas after the air is once evacuated therefrom. After the filling, the exhaust pipe is closed, whereby the sealed envelope 2 is completely sealed off.

Here, the sealed envelope 2 has a side tube 14 made of silica glass or UV-transmitting glass, which is formed like a cylinder whose one side is open, whereas the top part thereof is utilized as the circular light projection window 14*a*. The stem 4 is formed like a cylindrical column from glass (e.g., Kovar glass). The peripheral part of the stem 4 is provided with a first joint member (first peripheral portion) 15 made of a metal (e.g., Kovar metal), which comprises a cylindrical body portion 15*a* and a flange portion 15*b* radially extending like a brim from the lower end of the body portion 15*a*. The body portion 15*a* of the first joint member 15 is secured to the outer wall face of the stem 4 by fusion or bonding.

On the other hand, the open end side of the side tube 14 is provided with a second joint member (second peripheral portion) 16 made of a metal (e.g., Kovar metal), which comprises a cylindrical body portion 16*a* and a flange portion 16*b* radially extending like a brim from the lower end of the body portion 16*a*. The body portion 16*a* of the second joint member 16 is secured to the inner wall face of the side tube 14 by fusion or bonding. Their positioning can be carried out by a simple operation of just mounting the open end portion of the side tube 14 onto the flange portion 16*b*.

Figure 2:
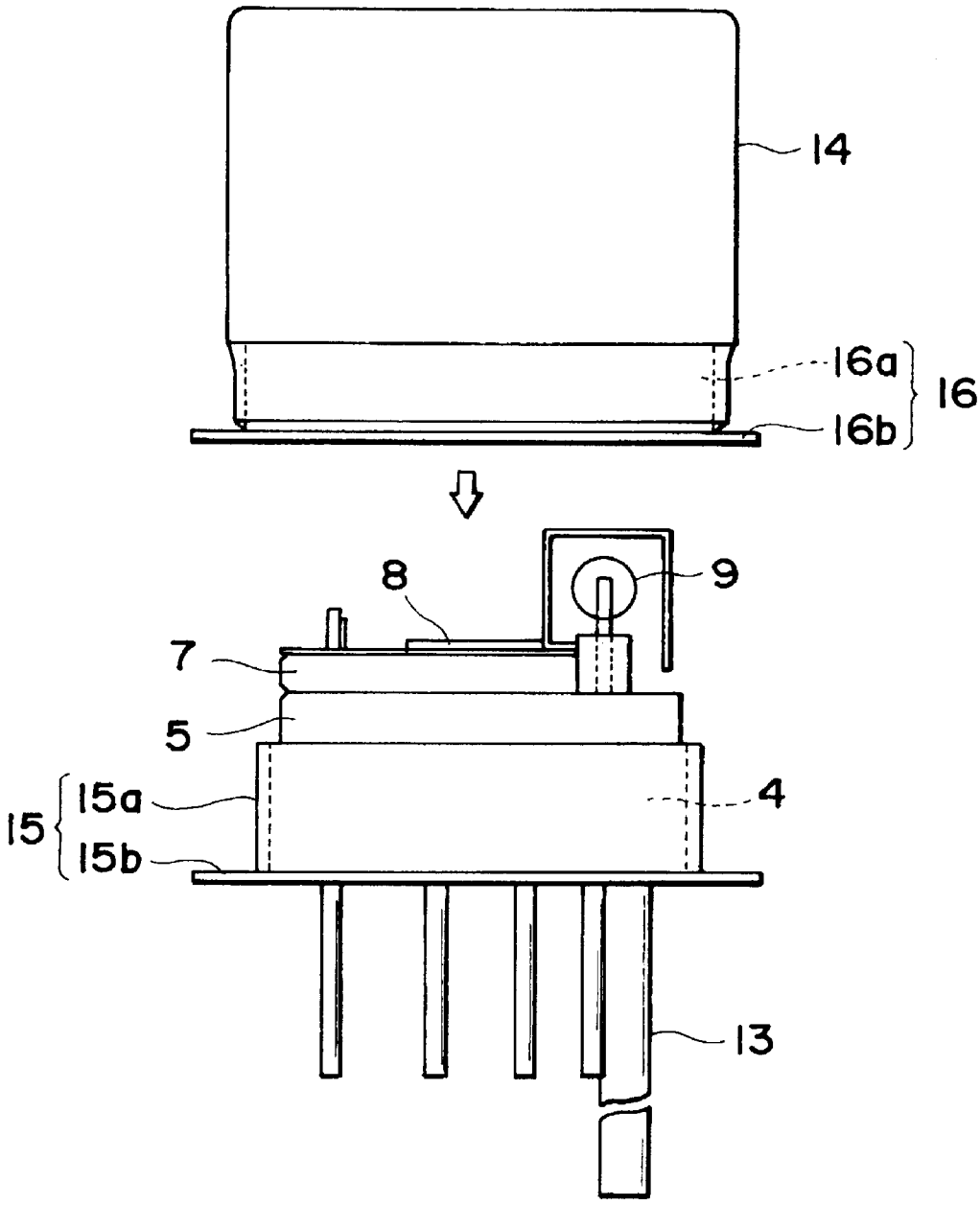
FIG. 2 is a front view showing a state of a stem and a side tube before they are welded to each other.

Hence, as shown in FIG. 2, while the stem 4 is being inserted into the side tube 14 in a state where the light-emitting part assembly 3 is secured onto the stem 4, the metal flange portion 15*b* of the stem 4 and the metal flange portion 16*b* of the side tube 14 are brought into close contact with each other and, with this state being maintained, thus joined part is subjected to a welding operation such as electric welding, laser welding, or the like, so as to effect hermetic sealing of the sealed envelope 2. After this welding operation, the air in the sealed envelope 2 is evacuated through the exhaust pipe 13, the sealed envelope 2 is subsequently filled with about several Torr of deuterium gas, and the exhaust pipe 13 is closed thereafter, whereby the assembling operation is completed. Here, the flange portion 15*b* can be utilized as a reference position with respect to the light-emitting part of the discharge tube 1 (the part where arc balls are generated in front of the focusing opening 8*a*). Namely, when the positional relationship between the first flange portion 15*b* and the light-emitting part is kept constant upon assembling the discharge tube 1, the positioning of the light-emitting part becomes easier, whereby the assembling workability and positioning accuracy with respect to an apparatus for driving the discharge tube (not shown) are expected to improve.

Operations of thus configured discharge tube 1 will now be explained in brief. First, an electric power of about 10 W is supplied from an external power source to the cathode section 9 for about 20 seconds, so as to preheat the cathode section 9. Thereafter, a DC release voltage of about 150 V is applied across the cathode section 9 and the anode plate 6, so as to prepare for arc discharge.

In the state where the preparation is in order, a trigger voltage of about 350 V to 500 V is applied across the cathode section 9 and the anode plate 6. Here, while being rectified by the discharge rectifying plate 11, the thermions released from the cathode section 9 converge at the focusing opening 8*a* of the focusing electrode plate 8 and reach the anode plate 6. Then, arc discharge occurs in front of the focusing opening 8*a*, and ultraviolet rays taken out from the arc balls generated upon this arc discharge are transmitted through the light projection window 14*a* of the side tube 14 and released outside, i.e., in the direction of arrow A.

Figure 3:
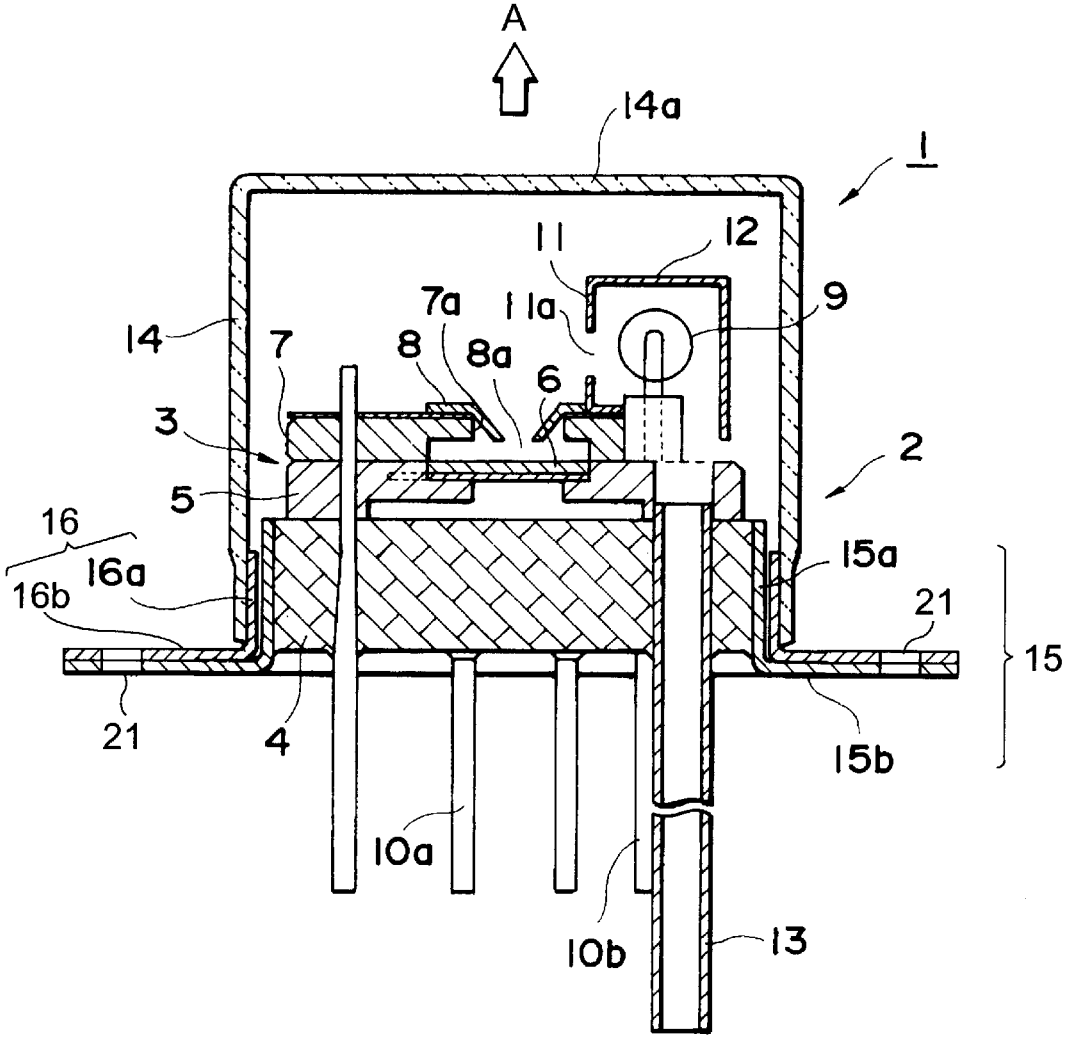
Figure 4:
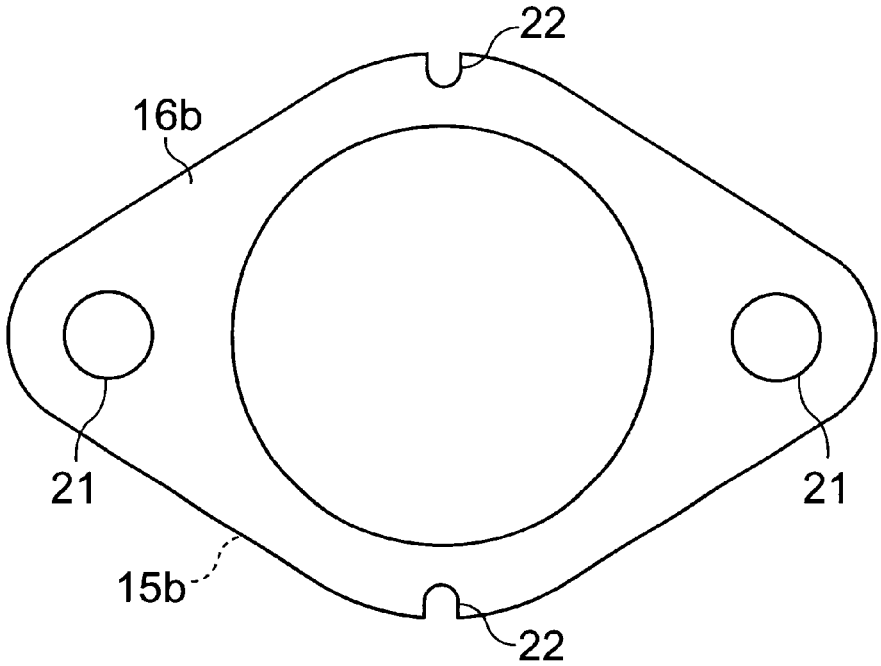
FIG. 4 is a plan view thereof.

FIG. 3 shows a sectional view of the gas discharge tube 1*a* of a second embodiment in accordance with the present invention, whereas FIG. 4 shows a plan view thereof. This embodiment differs from the first embodiment shown in FIG. 1 in that the respective flange portions 15*b*, 16*b* of the first and second peripheral portions 15, 16 have greater diameters and are provided with holes 21 for passing attachment screws and the like and positioning cutouts 22. Such a configuration further facilitates the positioning of the light-emitting part, whereby the assembling workability and positioning accuracy with respect to an apparatus for driving the discharge tube (not shown) are expected to improve.

The present invention should not be restricted to the above-mentioned embodiments. For example, the gas filling the sealed envelope 2 may include not only deuterium gas, but also mercury vapor, helium gas, neon gas, and the like. The present invention is also applicable to side-on type discharge tubes as a matter of course.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The gas discharge tube in accordance with the present invention is applicable not only to deuterium lamps, but also to mercury lamps, helium gas lamps, neon gas lamps, and the like; and is favorably usable as a gas discharge tube utilized as a light source for a spectroscope, chromatography, or the like in particular.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A gas discharge tube having a sealed envelope at least a part of which transmits light, said sealed envelope being filled with a deuterium gas and being provided with anode and cathode sections disposed therein, electric discharge being generated between said anode and cathode sections, so that the light-transmitting part of said sealed envelope emits predetermined light outside;

said sealed envelope comprising:

a stem for setting said anode and cathode sections within said sealed envelope by way of respective stem pins independent from each other;

a first peripheral portion made of a metal firmly attached to a peripheral part of said stem;

a second peripheral portion made of a metal secured to said first peripheral portion by welding; and a side tube, made of glass, surrounding said anode and cathode sections and having one end sealed with said second peripheral portion, wherein, at the sealed end of said side tube of said sealed envelope, said first peripheral portion, said second peripheral portion, and said side tube of said sealed envelope are nested in such a manner that at least a metal wall surface of at least one of said first and second peripheral portions is restricted from exposure to the deuterium gas in said sealed envelope.

2. A gas discharge tube according to claim 1, wherein said first peripheral portion has a flange portion.

3. A gas discharge tube according to claim 2, wherein said second peripheral portion has a flange portion being secured with a respective flange portion of said first peripheral portion by welding.

4. A gas discharge tube according to claim 3, wherein each of said flange portions is provided with a positioning portion for arranging said gas discharge tube.

* * * * *